US006039152A

United States Patent [19]

Schöps et al.

[11] Patent Number: 6,039,152

[45] Date of Patent: Mar. 21, 2000

[54] ELEVATOR SYSTEM WITH CONTROLLER LOCATED UNDER ELEVATOR LANDING

[75] Inventors: Karl-Friedrich Schöps; Wolfgang Warzecha, both of Berlin, Germany

[73] Assignee: Otis Elevator Company, Farmington, Conn.

[21] Appl. No.: 09/183,696

[22] Filed: Oct. 30, 1998

[51] Int. Cl.[7] ..... B66B 1/00

[52] U.S. Cl. ..... 187/414; 187/250

[58] Field of Search ..... 187/414, 303, 187/250, 318, 400, 254, 266

[56] References Cited

U.S. PATENT DOCUMENTS

| | | | |
|---|---|---|---|
| 917,919 | 4/1909 | Anderson | 187/250 |
| 1,071,309 | 8/1913 | Goggin . | |
| 3,101,130 | 8/1963 | Bianca . | |
| 4,600,086 | 7/1986 | Yamasaki et al. | 187/266 |
| 4,949,815 | 8/1990 | Pavoz | 187/20 |
| 5,429,211 | 7/1995 | Aulanko et al. | 187/254 |
| 5,435,417 | 7/1995 | Hakala | 187/404 |
| 5,469,937 | 11/1995 | Hakala et al. | 187/266 |
| 5,490,578 | 2/1996 | Aulanko et al. | 187/254 |

FOREIGN PATENT DOCUMENTS

| | | | |
|---|---|---|---|
| 1 032 496 | 6/1958 | Austria . | |
| 0 606 875 A1 | 1/1994 | European Pat. Off. . | |
| 0 779 233 A2 | 6/1994 | European Pat. Off. . | |
| 0 784 030 A2 | 6/1994 | European Pat. Off. . | |
| 0 688 735 A2 | 6/1995 | European Pat. Off. . | |
| 0 710 618 A2 | 10/1995 | European Pat. Off. . | |
| 0 749 930 A2 | 6/1996 | European Pat. Off. . | |
| 0 749 931 A2 | 6/1996 | European Pat. Off. . | |
| 2 640 604 | 12/1988 | France . | |
| 296 15 921 U1 | 4/1997 | Germany . | |
| 52-9245 | 1/1977 | Japan | 187/400 |
| 52-29048 | 3/1977 | Japan | 187/414 |
| 1-242386 | 9/1989 | Japan . | |
| 3-95088 | 4/1991 | Japan | 187/414 |
| 1684218 A1 | 10/1991 | U.S.S.R. | 187/414 |
| 2 138 397 | 11/1985 | United Kingdom . | |
| 2 2-1 657 | 8/1990 | United Kingdom . | |
| WO 96/09978 | 4/1996 | WIPO . | |

OTHER PUBLICATIONS

"Elevator Mechanical Design, Principles and Concepts", by Lubomir Janovsky, Ellis Horwood Limited (1987).

*Primary Examiner*—Robert P. Olszewski
*Assistant Examiner*—Thuy V. Tran

[57] ABSTRACT

An elevator system includes a hoistway defined in a surrounding structure, with a front wall that extends along a length of the hoistway. The front wall includes at least one elevator door frame that accommodates an elevator door, with a landing provided frontwardly of the elevator door frame. A recess defined in the front wall extends a predetermined distance along a length of the hoistway from a first end below the elevator door frame to a second end that opens into the landing. A controller is disposed within the recess to provide easy and safe access to the controller from the landing.

13 Claims, 3 Drawing Sheets

ELEVATOR SYSTEM WITH CONTROLLER LOCATED UNDER ELEVATOR LANDING

FIELD OF THE INVENTION

The present invention relates generally to an elevator system, and more particularly to an elevator system including an elevator controller located underneath an elevator landing in a recess adjacent to the hoistway.

BACKGROUND OF THE INVENTION

Considerable expense is involved in the construction of a machine room for an elevator. The expense includes the cost of constructing the machine room, the structure required to support the weight of the machine room and elevator equipment, and the cost of shading adjacent properties from sunlight (e.g., sunshine laws in Japan and elsewhere).

A machine room typically includes a controller which performs two main functions: operational control and motion control. In an elevator system which does not have a machine room, the controller should be located near the elevator itself, placed where it can be easily maintained, yet still not be visible for security and aesthetic reasons. Having easy access to the controller saves both time and money in inspection and maintenance costs, and can lead to expanded use of elevator systems.

The positioning of an elevator controller also requires consideration of the safety of the personnel maintaining and inspecting the controllers. Some controllers are currently located in the bottom of the hoistway, where there are problems with both access and safety. Elevator controllers are also located between the wall of the hoistway and an elevator car which is a narrow, restricted area that may be difficult and dangerous to access. Some elevator controllers are located above the elevator car. In this location personnel typically access the controller with difficulty by proceeding through the roof of the elevator car or climbing on top of the elevator car.

It is an object of the present invention to provide an elevator controller positioned for easy and safe access for maintenance and inspection.

SUMMARY OF THE INVENTION

An elevator system includes a hoistway defined in a surrounding structure. The hoistway includes a front wall that extends along a length of the hoistway, wherein the front wall includes at least one elevator door frame for accommodating an elevator door. A landing is provided substantially in front of the elevator door frame. A recess is defined by the front wall of the hoistway and extends a predetermined distance along a length of the hoistway from a first end below the elevator door frame to second end which opens into the landing. A controller is disposed within the recess to provide access to the controller from the landing for inspection and maintenance.

An advantage of the present invention is that the avoidance of construction of a machine room to house the elevator controller significantly reduces the cost of elevator installation and construction.

A second advantage of the present invention is that providing easy and safe access to the controller from a landing saves both time and money by encouraging quicker and more frequent maintenance and inspection of the controller.

A third advantage of the present invention is that the controller may be easily accessible for maintenance and inspection, yet the controller is concealed from elevator riders and protected from tampering with by unauthorized individuals.

Other advantages will be made apparent with references to the specification and accompanying drawings.

DETAILED DESCRIPTION OF THE PREFERRED EMBODIMENTS

Figure 1:
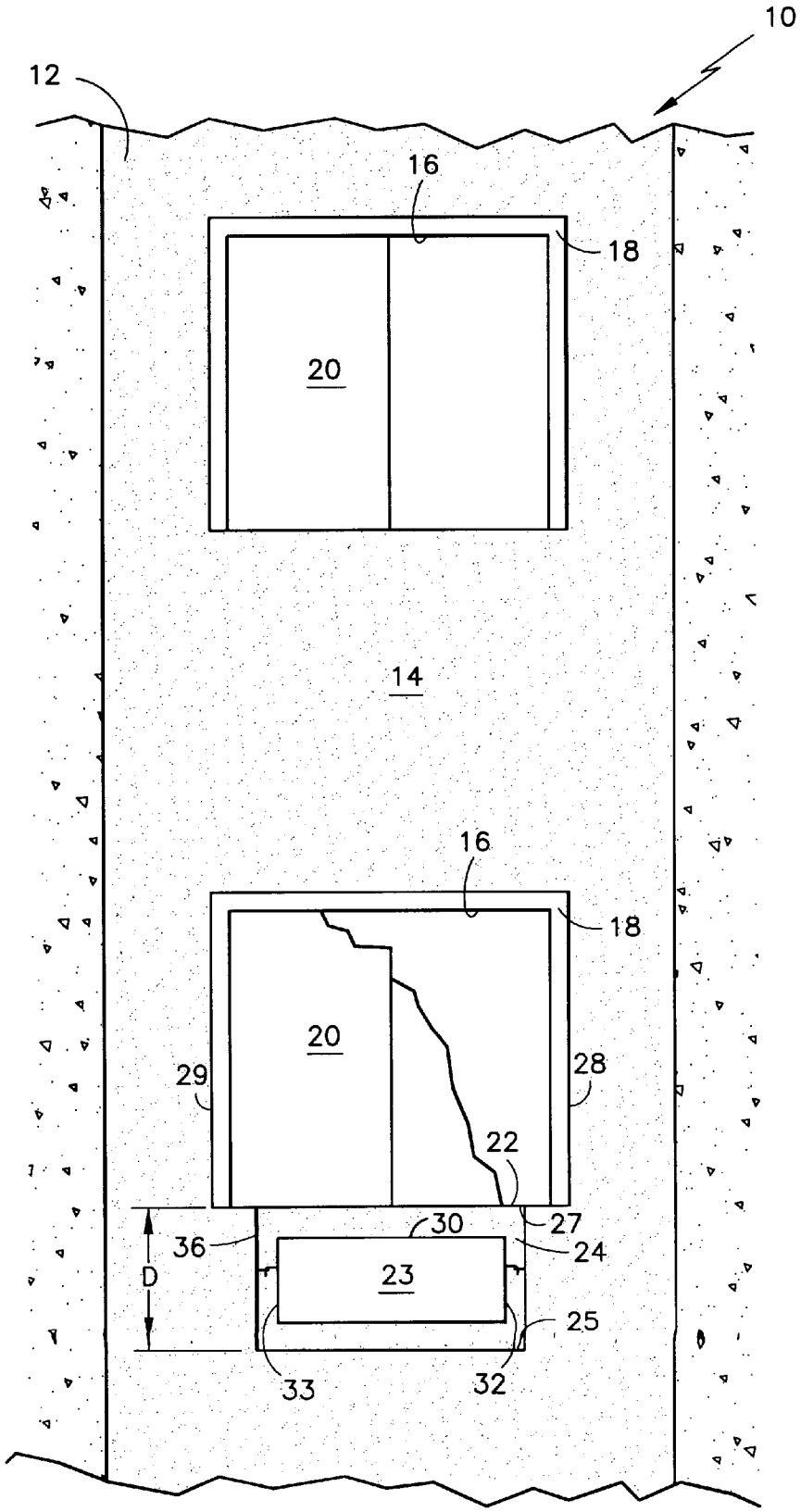
FIG. 1 is a schematic, partial, elevational view of a hoistway showing a recess accommodating an elevator controller as viewed from within the hoistway.

Referring to FIG. 1, an elevator system embodying the present invention is generally designated by the reference number 10. The elevator system 10 includes a hoistway 12 defined by a surrounding structure, such as a building or house. The surrounding structure defining the hoistway 12 includes a front wall 14 which extends upwardly along a length of the hoistway, and defines a plurality of openings 16, 16 each partially bordered by an elevator door frame 18. Each elevator door frame 18 accommodates at least one elevator door 20 for allowing access between an elevator door landing 22 and an elevator car (not shown). The landing 22 encompasses a platform or floor substantially in front of the elevator door frame 18 for loading and unloading passengers and cargo onto and off of an elevator car.

Figure 2:
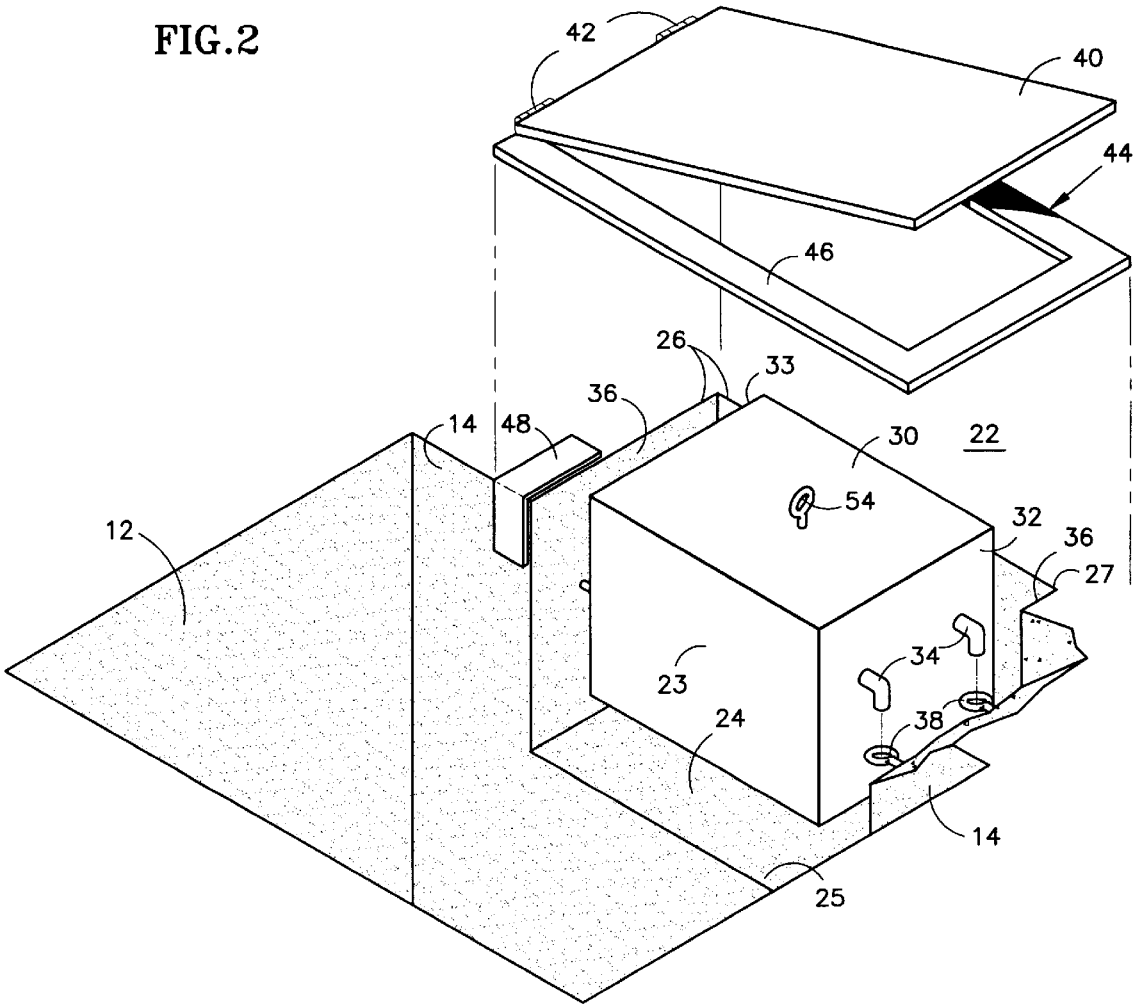
FIG. 2 is a schematic, partial, perspective view of a hoistway showing an elevator controller disposed in a recess adjacent to the hoistway.
Figure 3:
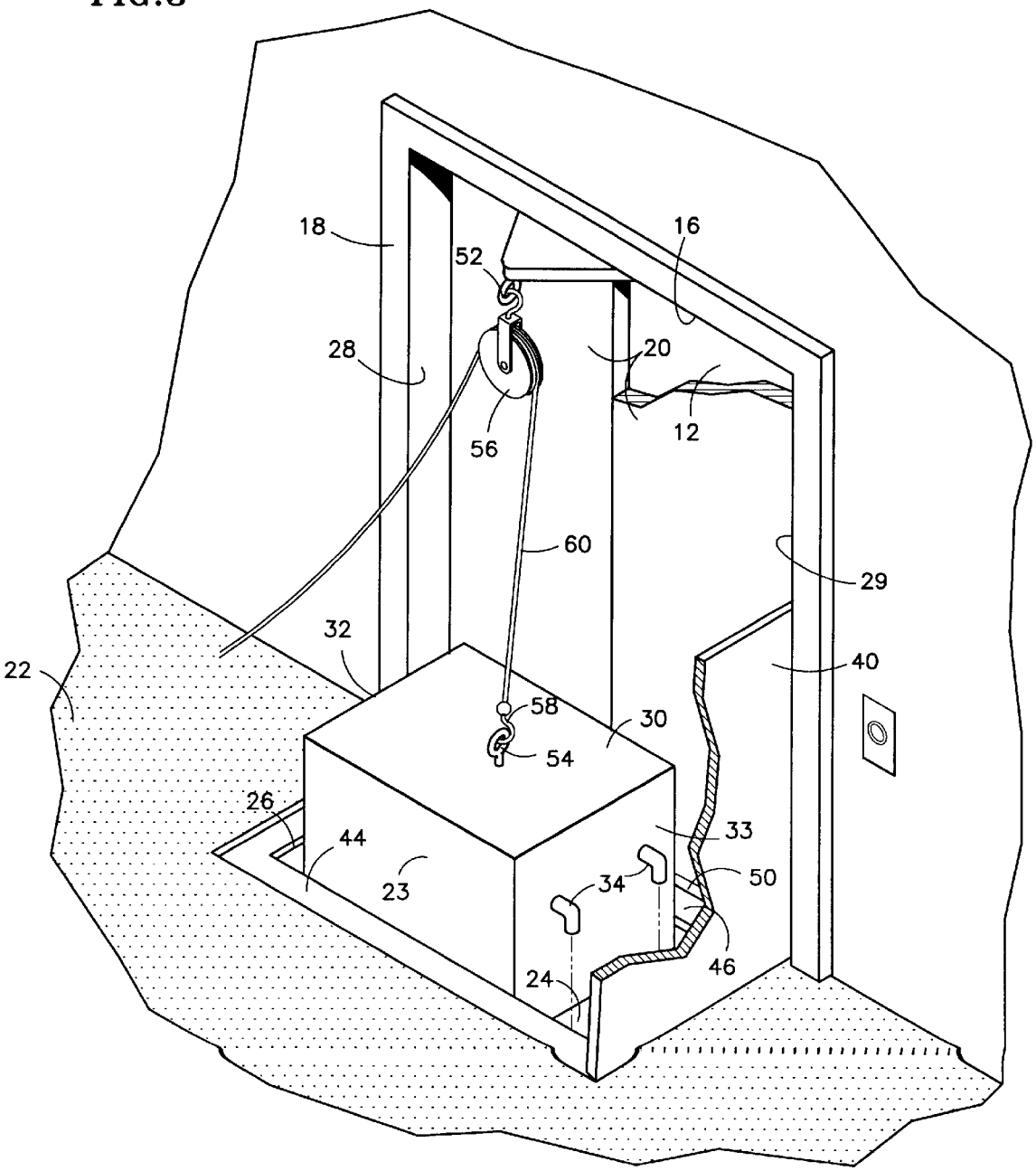
FIG. 3 is a schematic, partial, perspective view of an elevator door and frame illustrating an elevator controller partially raised above an elevator door landing.

As shown in FIGS. 1–3, the elevator system 10 also includes an elevator controller 23 which regulates the operation of the elevator system and the motion of an elevator car. For ease of illustration, in FIG. 2 the elevator controller 23 is disengaged. The controller 23 is disposed or suspended in a recess 24 that is defined in the front wall 14 of the hoistway 12 under one of the elevator door frames 18. Preferably, for ease of implementation, the recess 24 accommodating the controller 23 is located beneath a bottommost elevator door frame 18 in the hoistway 12. However, the recess 24 may be disposed beneath any elevator door frame 18 along the hoistway 12.

As shown in FIG. 1, the recess 24 extends a predetermined distance "D" along a length of the hoistway 12 from a first or lower end 25 below the elevator door frame 18 to a second or upper end 27 opening into the landing 22. The recess 24 also extends approximately between opposite sides of the elevator door frame 18 from a first side 28 to a second side 29. As shown in FIG. 2, the recess 24 is partially bordered by a top edge 26 extending partially about the top of the recess. Preferably, the recess 24 is approximately rectangular, but alternatively may be cube-shaped, semicircular, primarily round, or any other shape which facilitates easy access to the controller 23 from the landing 22 and permits physical and electrical communication between the controller and the hoistway 12.

As shown in FIGS. 1–3, the controller 23 includes a top portion 30 and at least one side portion 32, and is approximately rectangular, but alternatively the controller may be any other suitable shape. In order to secure or suspend the controller 23 within the recess 24, a securing means such as at least one eyebolt 38 (See FIG. 2) is fastened to the front wall 14 of the hoistway 12, preferably at a recess wall 36 or a portion of the front wall 36 defining the recess. The securing means may also include, for example, at least one hook 34 (See FIG. 2) fastened to the at least one side portion 32 of the controller 23 for securing and suspending the controller within the recess 24 adjacent to but out of the way of the hoistway 12.

Preferably, as best shown in FIG. 2, the eyebolts 38, 38 are fastened to the recess wall 36 to oppose one side 32 of the controller 23, and two hooks 34, 34 are fastened to the same side 32 of the controller for engaging the corresponding eyebolts 38, 38 to secure and suspend the controller within the recess 24. Similarly, two eyebolts 38, 38 (not shown) are fastened to the recess wall 36 to oppose another side 33 of the controller 23, and two hooks 34, 34 (not shown) are fastened to the side 33 of the controller for engaging the eyebolts. However, other means for securing the controller 23 may be substituted, such as a track coupled to either the recess wall 36 or to a side of the controller, and hooks or other type of catches attached to the recess wall or side of the controller opposite the track for attaching to the track.

Referring to FIGS. 2 and 3, a movable cover 40 overlies the top edge 26 of the recess 24 in order to conceal the controller 23 from elevator riders and to protect the controller from tampering with by unauthorized individuals when the cover is closed. The cover 40 also provides easy and safe access to the controller 23 for maintenance and inspection from the landing 22 when the cover is open. The upper surface of the cover 40 is preferably positioned so that it is approximately flush with the landing 22 so as to not interfere with the loading and unloading of passengers and cargo onto an elevator car. The cover 40 is fastened to a recess frame 44 which underlies and supports the cover. Preferably, means coupling the cover 40 to the recess frame 44 for opening the cover to expose the recess 24 and closing the cover over the recess includes hinges 42, 42 which pivotally attach the cover to the recess frame. Other means for opening and closing the cover may be substituted, such as a clasp coupled to the cover and a loop coupled to the recess frame for detaching the cover from the recess frame.

Still referring to FIGS. 2 and 3, the recess frame 44 overlies the top edge 26 of the recess 24 and includes a section 46 which extends approximately between the first side 28 and the second side 29 of the elevator door frame 18. In order to adjustably position a height of a top surface of the closed cover 40 so as to be approximately flush with the landing 22, the recess frame 44 is mounted on at least one support 48 (See FIG. 2). For example, the support 48 may be a bracket coupled between the front wall 14 of the hoistway 12 and the recess frame 44. Other means for adjusting the height of the cover 40 may be substituted, such as multiple brackets or angle irons.

As schematically illustrated in FIG. 3, an elevator door track 50 overlies and is supported by the section 46 of the recess frame 44 and extends approximately between the first and second sides 28 and 29 of the elevator door frame 18 for supporting and guiding the elevator doors 20. A means for raising at least a portion of the controller 23 above the landing 22 for easy access for inspection and maintenance is provided. The means for raising includes, for example, a first coupling means or eyebolt 52, disposed above or to the top of the elevator door frame 18. Other locations for the mounting of the eyebolts 52 may be substituted, such as to the ceiling (not shown). Moreover, other means for coupling may be substituted, such as a hook or other type of catch.

The means for raising further includes a second coupling means or eyebolt 54 attached to the top 30 of the controller 23. Other locations for attaching an eyebolt to the controller 23 may be substituted, such as a side 32 of the controller, and other means for coupling may be substituted, such as a hook or other type of catch. The means for raising further includes a winch 56 removably mounted on the eyebolt 52 for raising at least a portion of the controller 23 above the landing 22. A rope 60, which may be round or flat, and which may be made, for example, of fiber or steel, is coiled on the winch 56. A free end of the rope includes a winch hook 58 which is removably engageable to the eyebolt 54 on the controller 23.

In operation, the controller 23 is disposed in the recess 24 that is under the landing 22 approximately in front of the elevator door frame 18. The controller 23 is secured or suspended in the recess 24 by the coupling of the hooks 34 and eyebolts 38 to the recess wall 36. The controller 23 is concealed from elevator riders, and protected from tampering with by unauthorized personnel by the cover 40 when positioned over the recess 24 in a closed position. Further, the controller 23 is adjacent to both the landing 22 for ease of access and to the hoistway 12 for ease of implementation, yet out of the way of the hoistway for safety and so as not to interfere with elevator car travel therealong.

To access the controller 23 from the landing 22, the cover 40 is opened by pivoting the cover about the hinges 42 so as to reveal the controller. Alternatively, the cover 40 may be completely removed from the recess frame 44 for revealing the controller 23 from the landing 22. When the cover 40 is either in an open position or removed from over the recess 24, the top 30 of the controller 23 is easily and safely accessible for maintenance or inspection.

If access is required to other sides 32 of the controller 23, at least a portion of the controller may be raised above the landing 22 by mounting the winch 56 onto the eyebolt 52 above the landing, engaging the winch hook 58 with the eyebolt 54 on the top portion of the controller, and rotating the winch to raise at least a portion of the controller above the landing in order to easily and safely perform from the landing any necessary maintenance and inspection.

Although this invention has been shown and described with respect to an exemplary embodiment thereof, it should be understood by those skilled in the art that the foregoing and various other changes, omissions, and additions in the form and detail thereof may be made therein without departing from the spirit and scope of the invention. Accordingly, the present invention as shown and described in the various embodiments has been presented by way of illustration rather than limitation.

What is claimed:

1. An elevator system comprising:

a hoistway defined in a surrounding structure having a front wall extending along a length of the hoistway, the front wall including at least one elevator door frame for accommodating an elevator door;

a landing provided frontwardly of the elevator door frame;

a recess extending a predetermined distance along a length of the hoistway from a first end below the elevator door frame to a second end opening into the landing; and a controller disposed within the recess.

2. An elevator system as defined in claim 1, wherein the recess has a top edge extending along the top of the recess, and further including:

a cover movably disposed in the landing over the recess to provide access to the controller from the landing;

a recess frame supporting the cover and overlying the top edge of the recess, the recess frame including a section extending between opposite sides of the elevator door frame; and means coupling the cover to the recess frame for opening the cover to expose the recess and for closing the cover over the recess.

3. An elevator system as defined in claim 2, wherein the opening and closing means includes at least one hinge pivotally attaching the cover to the recess frame.

4. An elevator system as defined in claim 2, further including an elevator door track for supporting an elevator door, the elevator door track overlying the section of the recess frame extending between opposite sides of the elevator door frame.

5. An elevator system as defined in claim 2, further including at least one bracket coupled to the front wall of the hoistway and the recess frame for adjusting the height of the cover so that an upper surface of the cover is approximately flush with the landing when in a closed position.

6. An elevator system as defined in claim 2, wherein the cover is disposed in the landing over the recess so that an upper surface of the cover is approximately flush with the landing when in a closed position.

7. An elevator system as defined in claim 1, further including means for securing the controller to a portion of the front wall defining the recess.

8. An elevator system as defined in claim 7, wherein the securing means includes at least one eyebolt attached to the portion of the front wall defining the recess, and at least one hook attached to a side of the controller for engaging the eyebolt to secure the controller in the recess.

9. An elevator system as defined in claim 1, further including means for raising at least a portion of the controller above the landing for easy access.

10. An elevator system as defined in claim 9, wherein the means for raising includes a first coupling means disposed above the elevator door frame, a second coupling means attached to the controller, and a winch removably mounted on the first coupling means and including a rope coupled at its free end to the second coupling means.

11. An elevator system as defined in claim 10, wherein the first coupling means includes at least one eyebolt disposed above the landing.

12. An elevator system as defined in claim 10, wherein the second coupling means includes at least one eyebolt attached to a top portion of the controller.

13. An elevator system as defined in claim 1, wherein the controller is disposed beneath a bottommost elevator door frame along the hoistway.

* * * * *